US011173578B2

(12) United States Patent
Boel

(10) Patent No.: US 11,173,578 B2
(45) Date of Patent: Nov. 16, 2021

(54) DEVICE, SANDING FRAME, SANDING ELEMENT, METHOD AND KIT FOR SANDING FLOOR AREAS

(71) Applicant: IN2-CONCRETE BVBA, Oosterzele (BE)

(72) Inventor: Koenraad Boel, Oosterzele (BE)

(73) Assignee: IN2-CONCRETE BVBA, Oosterzele (BE)

( * ) Notice: Subject to any disclaimer, the term of this patent is extended or adjusted under 35 U.S.C. 154(b) by 169 days.

(21) Appl. No.: 16/492,658

(22) PCT Filed: Mar. 8, 2018

(86) PCT No.: PCT/IB2018/051519
§ 371 (c)(1),
(2) Date: Sep. 10, 2019

(87) PCT Pub. No.: WO2018/163102
PCT Pub. Date: Sep. 13, 2018

(65) Prior Publication Data

US 2020/0376622 A1 Dec. 3, 2020

(30) Foreign Application Priority Data

Mar. 10, 2017 (BE) ..... 2017/5150

(51) Int. Cl.
*B24B 7/18* (2006.01)
*B24B 27/00* (2006.01)
(Continued)

(52) U.S. Cl.
CPC ..... *B24B 7/186* (2013.01); *B24B 27/0076* (2013.01); *A47L 11/4038* (2013.01); *B24B 41/02* (2013.01); *B24B 41/047* (2013.01)

(58) Field of Classification Search
CPC ..... B24B 7/186; B24B 7/18; B24B 7/188; B24B 27/0076; B24B 41/02;
(Continued)

(56) References Cited

U.S. PATENT DOCUMENTS 8,715,039 B2 5/2014 Chen
2006/0025059 A1 2/2006 Gueorguiev et al.
(Continued)

FOREIGN PATENT DOCUMENTS

CA 2664221 A1 10/2010
DE 9404357 U1 7/1995
(Continued)

OTHER PUBLICATIONS

WIPO, ISR for PCT/IB2018/051519, dated Jun. 26, 2018.

*Primary Examiner* — Joseph J Hail
*Assistant Examiner* — Michael A Gump
(74) *Attorney, Agent, or Firm* — Hodgson Russ LLP

(57) ABSTRACT

The present invention relates to a device (14) for sanding floor areas, the device comprising a frame, a steering, a motor which is provided to said frame, a subframe (13) rotatably coupled with said motor, said subframe being centrally provided with an adapter (7) along the lower side, a sanding frame (1), said sanding frame being centrally provided with a receiver (2) along the upper side, said receiver receiving said adapter, and at least one holder (5) for sanding elements, said holder being provided along the lower side of said sanding frame and being suitable for the attachment of sanding elements (15). In particular, the subframe is freely supported by the sanding frame, via said adapter and receiver, said adapter and receiver being rotationally coupled. In other aspects, the invention relates to a
(Continued)

sanding frame, a sanding element and a method for sanding floor areas, as well as a floor area obtained by application of said method.

6 Claims, 3 Drawing Sheets

(51) Int. Cl.
*A47L 11/40* (2006.01)
*B24B 41/02* (2006.01)
*B24B 41/047* (2006.01)

(58) Field of Classification Search
CPC . B24B 41/047; B24B 41/0475; B24B 23/022; B24B 39/06; B24B 45/00; B24B 45/006; A47L 11/4038; B24D 3/34; B24D 7/04
USPC ..... 451/353
See application file for complete search history.

(56) References Cited

U.S. PATENT DOCUMENTS

| | | | | |
|---|---|---|---|---|
| 2009/0028643 | A1* | 1/2009 | Snyder | B24B 7/186 404/112 |
| 2012/0270483 | A1* | 10/2012 | Bae | B24B 7/186 451/540 |
| 2016/0136772 | A1 | 5/2016 | Littlefield et al. | |
| 2018/0015588 | A1* | 1/2018 | Rogers | B24B 7/186 |
| 2018/0202176 | A1* | 7/2018 | Ahonen | E04F 21/245 |
| 2018/0289232 | A1* | 10/2018 | LaBarbera | B24B 45/006 |
| 2018/0333820 | A1* | 11/2018 | Stark | B24D 5/06 |
| 2019/0084126 | A1* | 3/2019 | Stark | B24D 7/066 |

FOREIGN PATENT DOCUMENTS

| | | | |
|---|---|---|---|
| DE | 102009038583 | A1 | 3/2011 |
| WO | 2008088908 | A1 | 7/2008 |
| WO | 2009027643 | A1 | 3/2009 |

* cited by examiner

DEVICE, SANDING FRAME, SANDING ELEMENT, METHOD AND KIT FOR SANDING FLOOR AREAS

TECHNICAL FIELD

The invention is related to the sanding of floor areas. More in particular, the invention is related to devices, sanding frames, sanding elements, methods and kits for sanding concrete and stone floor areas. Further, the invention is related to the treated floor areas obtained hereby.

PRIOR ART

Power trowels for levelling/trowelling concrete mortar during hardening are known in the prior art. Such machines comprise a motor and one or more blade rotors with trowel blades, that are rotatably provided in the plane to be levelled. The motor supplies driving of the blade rotors. The motor is typically enclosed in a superstructure that is vertically supported by the blade rotors. Because this superstructure with motor is quite heavy, the blade rotors exercise a considerable pressure on the concrete mortar to be levelled. An advantage is that the levelling process thereby proceeds more efficiently.

The levelling of concrete mortar during hardening is usually done in two or more levelling steps. A first levelling step takes place soon after pouring. The concrete mortar is then still insufficiently viscous to support the power trowel directly via the blade rotor. Therefore, during this first levelling step, a floating disc is typically attached under the blade rotor, said floating disc offering a larger, disc-shaped support surface. Such floating discs are often provided with a system with hooks, along the upper side, upon which the trowel blades of aforementioned blade rotors can engage.

CA 2 664 221 A1 describes a sanding frame with an upper side on which blade rotors of power trowels can engage in similar manner. Further, said subframe is provided with sanding elements along the lower side. An advantage is that the sanding frame thereby can be used in combination with classical power trowels for sanding floor areas of concrete and stone. Typically, the sanding elements should be replaced regularly. A disadvantage of said sanding frame, however, is that it is quite laborious to replace the sanding elements.

WO 2009 027 643 A1 describes a system that allows a drive shaft to be removably coupled with a tool for the cleaning or treating of floors. The drive shaft leads in this regard to a hexagonal connection head, that can be inserted in a hexagonal recess provided thereto along the rear side of the tool. The mutual coupling is such that the tool can tilt with respect to the drive shaft having the connection head. This results in a high manoeuvrability of the tool. Further, interlocking elements are provided for maintaining the mutual coupling. In this way, the tool can be detached from and connected to the drive shaft. A disadvantage is that the detachable connection is tiltable. The connection is thereby weaker and more susceptible to wear. Therefore, it is unsuitable for use in combination with power trowels, or in combination with a heavy superstructure comprising a motor, for example for sanding large floor areas of concrete and stone.

U.S. Pat. No. 8,715,039 B2 describes a machine hand tool for sanding small areas. Said tool comprises an axially rotatable sanding frame that is provided with several holders for sanding elements, and further a motor for driving said sanding frame. A sanding element is coupled with each of said holders. The corresponding sanding zones of the sanding elements are in this regard enclosed in a same, transversal sanding plane. Upon driving the sanding frame, all sanding elements start rotating synchronously in the sanding plane. An advantage is that in the same operation a larger sanding area can be treated, by simultaneous use of several smaller sanding elements. A disadvantage is that said tool is a hand tool and therefore typically not suitable for sanding (large) floor areas.

There is a need for a device for sanding floor areas. In particular, this device must allow the sanding elements to be replaced in a simple manner. Preferably, said device can be used in combination with a classical power trowel, for sanding floors made of concrete or stone.

The invention seeks to find a solution for at least some of above-mentioned problems.

SUMMARY OF THE INVENTION

In a first aspect, the invention relates to a device for sanding floor areas according to claim 1, the device comprising a frame, a steering and a motor, said motor being provided on said frame, the device further comprising:

- a subframe rotatably coupled with said motor, the motor being suitable for bringing said subframe into rotation, said subframe being centrally provided with an adapter along the lower side,
- a sanding frame, said sanding frame being centrally provided with a receiver along the upper side, said receiver receiving said adapter, and
- at least one holder for sanding elements, said holder being provided along the lower side of said sanding frame and being suitable for the attachment of sanding elements.

In particular, the subframe is freely supported by the sanding frame via said adapter and receiver, said adapter and receiver being rotationally coupled.

It is typical for such devices that the sanding elements require regular replacing, for example because of wear or because a transition is made to a finer sanding element every time a finer sanding action is intended. An advantage of the device according to the present invention is that it allows the sanding elements to be replaced in a simple manner. In this regard, the subframe is first vertically raised with respect to the sanding frame, so that said sanding frame is detached. The sanding frame is only part of the device, and can thus be more easily handled and/or more easily provided with other or new sanding elements.

In a further embodiment according to claim 2, the device comprises another blade rotor, the subframe comprising means along the upper side for detachable coupling thereof with said blade rotor. In this regard, the device allows a power trowel (with a blade rotor) to be deployed as sanding machine in a simple and not-definitive manner. Typically, such power trowels are quite heavy, so that a coupling of the adapter and receiver via free loading suffices. In this regard, the sanding elements can be simply replaced, to which end the subframe is raised with respect to the sanding frame, which leads to a decoupling of the subframe and the sanding frame.

In a second aspect, the invention describes a sanding frame.

In a third aspect, the invention describes a sanding element.

In a further aspect, the invention describes a method for treating floor areas.

In a further aspect, the invention describes a floor. In particular, said floor comprises a floor area, said floor area being obtained by application of the method.

In a further aspect, the invention describes a kit for sanding floor areas

DETAILED DESCRIPTION

Figure 1:
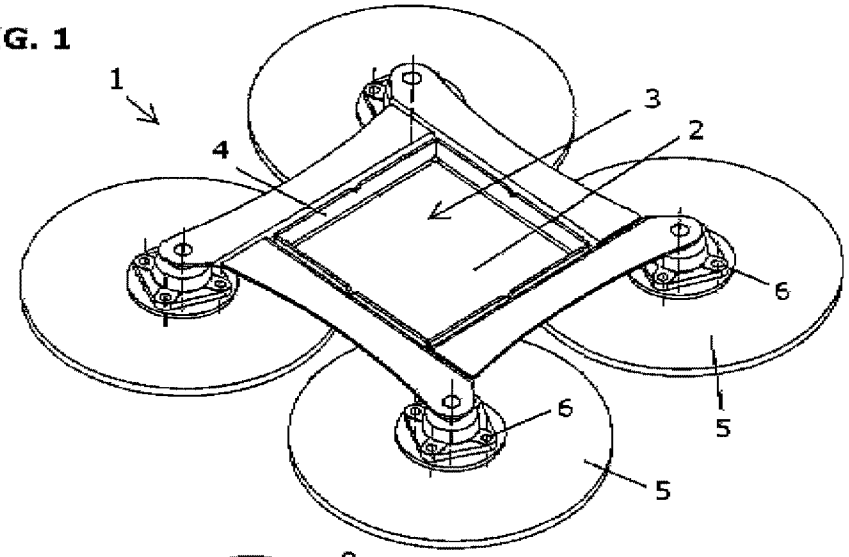
FIG. 1 shows a perspective drawing of an embodiment of a sanding frame according to the present invention.

The invention is related to the sanding of floor areas. More in particular, the invention is related to devices, sanding frames, sanding elements, methods and kits for sanding concrete and stone floor areas. Further, the invention is related to the treated floor areas obtained hereby.

Unless otherwise defined, all terms used in the description of the invention, technical as well as scientific terms, have the same meaning as generally understood by the person skilled in the technical field of the invention. For a better appraisal of the description of the invention, the following terms are explicitly explained.

In this document, "a", "an" and "the" refer to the plural as well as the singular unless the context clearly suggests otherwise. For example, "a segment" means one or more than one segment.

The terms "comprise", "comprising", "provided with" are synonyms and are inclusive or open terms indicating the presence of that which follows, and which do not exclude or bar the presence of other components, features, elements, members, steps, known from or described in the prior art.

The citation of numerical intervals by the end points comprises all whole numbers, fractions and/or real numbers between the end points, including said end points.

In a first aspect, the invention relates to a device for sanding floor areas, the device comprising a frame, a steering and a motor, said motor being provided to said frame, the device further comprising:

- a subframe rotatably coupled with said motor, the motor being suitable for bringing said subframe into rotation, said subframe being centrally provided with an adapter along the lower side,
- a sanding Frame, said sanding frame being centrally provided with a receiver along the upper side, said receiver receiving said adapter, and
- at least one holder for sanding elements, said holder being provided along the lower side of said sanding frame and being suitable for the attachment of sanding elements.

In particular, the subframe is freely supported by the sanding frame, via said adapter and receiver, said adapter and receiver being rotationally coupled.

The device is therefore suitable for sanding floor areas. Thereto, a sanding element is attached to each of said holders. The corresponding sanding zones are, in this regard, enclosed in a same horizontal sanding plane, said sanding plane extending along the horizontal floor area. The remaining part of the device, comprising the sanding frame, the subframe, the frame and the motor, is vertically supported by said sanding elements.

The subframe is rotationally coupled with the sanding frame, since the adapter and the receiver are rotationally coupled, the adapter being enclosed by the subframe and the receiver being enclosed by the sanding frame. The term "rotationally coupled" in this document refers to the type of coupling between adapter and receiver. More in particular, in coupled state of adapter and receiver, each rotation of the adapter around the vertical will be accompanied by a same rotation of the receiver around the vertical. This coupling (or rotation-coupling), however, is removable, as specified below. The same applies for the subframe and the sanding frame, where, in rotationally coupled state, each rotation of the subframe around the vertical is accompanied by a same rotation of the sanding frame.

Upon use of the device, there is in first instance no rotation of the frame with respect to the floor area, as is also the case with power trowels. Upon actuation of the motor, the subframe is subsequently brought into rotation with respect to that (non-rotating) frame, around the vertical direction. Said subframe thus turns with respect to the floor area. The same applies for the sanding frame, since said sanding frame is rotationally coupled with said subframe via the rotationally coupled adapter and receiver. All sanding elements thus start rotating synchronously in the horizontal sanding plane, along the floor area. With that, the floor area is sanded.

The term "sanding" should, in this connection, be understood as comprising sanding, polishing, cleaning, rubbing up, grinding and milling. The device is therefore inter alia suitable for the sanding, polishing, cleaning, rubbing up, grinding and milling of floor areas, the sanding elements being chosen by the person skilled in the art according to the intended treatment. According to a non-restrictive example, the device is suitable for the sanding off of old, worn and/or stained concrete floors, so that a new, clean and even floor area becomes visible. On the other hand, it is also possible to mill away a top layer of a concrete floor with granulates, so that the floor area shows the transected granulates. Such floors are better known as terrazzo floors. Preferably the device is used in particular for sanding floor areas of concrete or stone.

The subframe is "freely supported" by the sanding frame, via the adapter and receiver. In this document, a top part that is "freely supported" by a bottom part designates that the top part can be raised vertically with respect to the bottom part, at least to a point where both parts no longer make contact. They are then no longer coupled, and in particular the parts are no longer rotationally coupled.

Preferably a freely supported coupling comprises no interlocking elements for the interlocking of said freely supported coupling. In this regard, the rotational coupling is maintained by the weight of the parts of the device that are supported by the coupling.

In the present device, the subframe is rotationally coupled with the sanding frame, via the adapter that is enclosed in the receiver in a rotationally coupled manner. The subframe is, in this regard, freely supported by the sanding frame, via that same adapter and receiver. As described above, it suffices for detaching of the coupling to raise the subframe vertically with respect to the sanding frame. The sanding frame itself will then remain lying loose on the floor area. When the subframe is raised vertically, the adapter leaves the receiver, sliding vertically upwards from the upwardly directed receiving recess of the receiver. Upon reaching the point where the adapter has completely left the receiver, the sanding frame is no longer rotationally coupled with the subframe. The sanding frame can then be slid horizontally sidewards from under the remainder of the device, Conversely, for realising the coupling between the subframe and the sanding frame, the sanding frame is brought under the subframe. The subframe is subsequently lowered, the adapter and receiver being aligned such that the adapter slides vertically downwards into the upwardly directed receiver/receiving recess. The subframe is then freely supported by the sanding frame. Moreover, the subframe is then rotationally coupled with the sanding frame.

In summary, there are two special states in which the device can find itself. On the one hand, the device can find itself in the lowered state, the subframe being freely supported by the sanding frame and said subframe being rotationally coupled with said sanding frame. On the other hand, the device can find itself in the raised state, the subframe being vertically raised and no longer coupled with the sanding frame. Preferably the device comprises one or more vertical spindle jacks and/or spindle jack wheels, with which the subframe can be vertically raised with respect to the sanding frame. Preferably the adapter and/or the connector comprise rounded edges, for simplifying the coupling.

It is typical for such devices that the sanding elements require regular replacing, for example because of wear or because a transition is made to a finer sanding element, every time a finer sanding action is intended. An advantage of the device according to present invention is that it allows the sanding elements to be replaced in a simple manner. In this regard, the subframe is first vertically raised with respect to the sanding frame, so that said sanding frame is detached. The sanding frame is only part of the device, and can thus be more easily handled and/or more easily provided with other or new sanding elements. For example, the sanding frame is subsequently slid horizontally sidewards from under the remainder of the device. It is advantageous in this regard that no additional interlocking elements need to be detached. It is now possible to provide said uncoupled sanding frame with other/fresh sanding elements, and to subsequently slide said sanding frame back under said subframe. An alternative possibility is to slide another, second sanding frame under the subframe, said sanding frame already having been provided with other/new sanding elements. In each case, the lowering of the subframe on the sanding frame again results in a rotation-coupling of said subframe to said sanding frame. The sanding elements can so be replaced in a very simple manner.

According to a preferred form of the device, the adapter, upon use, extends downwardly in vertical direction, with a constant horizontal profile called the inner profile. On the other hand, the receiver, upon use, offers an upwardly directed receiving recess, also having a constant horizontal profile called the outer profile. Preferably, the inner and outer profiles are "form-fitting". Both profiles in this regard are of such shape and size that the vertically slid-in adapter cannot rotate independently with respect to the receiver, around the vertical direction. A form-fitting adapter and receiver can be rotationally coupled. According to an alternative embodiment of the device, the adapter, upon use, defines a downwardly directed receiving recess, within which the upwardly directed receiver is form-fittingly enclosed. In accordance with the chosen embodiment, the downwardly directed adapter can be enclosed in an upwardly directed receiving recess of a receiver, or the downwardly directed adapter, by means of a receiving recess thereof, can be enclosed over an upwardly directed receiver.

Further, the invention is not necessarily restricted to an adapter comprising only one part that is centrally arranged; optionally the adapter comprises two or more adapter parts which are decentrally arranged and assuming a central configuration. In this regard, said adapter parts enclose corresponding parts of the receiver and/or are enclosed in corresponding parts of the receiver, Of course the device can be applied more generally on flat and/or curved, horizontal and/or sloping floors, the description above being applicable mutatis mutandis.

According to a further preferred embodiment, the adapter and receiver are form-corresponding. As described above, the adapter then has a constant inner profile, that can form-correspondingly be enclosed in the outer profile of the receiving recess of the receiver. Both profiles in this regard have the same form, while the inner profile is smaller or equal in size to the outer profile. Preferably the inner profile is approximately equal in size to the outer profile. An advantage of a form-corresponding adapter and receiver is that these can be rotationally coupled in a rigid manner. That same coupling can be simply released by sliding out the adapter.

Optionally the adapter comprises two or more adapter parts, said adapter parts being form-fittingly disposable in and/or over the receiver. In doing so, a rotation-coupling between adapter and receiver is established.

According to a further preferred embodiment, the adapter has a polygonal profile. With further preference, the polygon is regular. An advantage is that such profiles are easy to design. The adapter and/or the receiver are therefore easier to manufacture. The greater the number of angles of the polygonal profile, the greater the risk of slipping of the rotation-coupling. This is in particular the case upon frequent use of the device, in which case the adapter and receiver can be subject to significant wear and/or deformations. The invention is however by no means hereto restricted. For example, the adapter and/or receiver may also be oval.

According to a further preferred embodiment, the adapter has a square profile. An advantage of a square profile is that this is very simple to design, and adapter and receiver thus being easy to manufacture. According to a non-restrictive embodiment, the receiver consists of four steel tubes of equal length that are welded together in a square connection. A square profile, upon wear and/or deformations, will also less frequently result in rotation-coupling slip. According to a non-restrictive example, the sanding frame comprises a square receiver, suitable for receiving a square adapter. Further, said sanding frame is provided along the lower side with four holders for sanding elements which are decentrally positioned, near the four corners of that square. An advantage is that decentrally rotating sanding elements wear off more evenly. However, according to alternative embodiment, the sanding frame can equally well be provided with one, two, three, four, five or six sanding elements, preferably three or four.

Preferably the adapter, in profile, occupies an area of at least 25 $cm^2$. The area concerned is defined as being the area that is enclosed by the extreme edges of that adapter profile. With further preference, said area is minimally 100 $cm^2$, with further preference minimally 200 $cm^2$ and with further preference minimally 400 $cm^2$. Preferably said area is maximally 1 $m^2$. According to a nonrestrictive embodiment, the adapter has a constant, square profile with sides of 20 cm. Said adapter can moreover be form correspondingly enclosed in the receiver. Preferably, the length of the adapter is minimally 0.5 cm and maximally 10 cm, with further preference minimally 2 cm and maximally 5 cm. Preferably, the adapter and/or the receiver comprise steel. Advantages hereof are the limited susceptibility to wear and deformations, the high breaking strength and the possibility of welding to other parts comprising steel. Said steel can be either stainless steel or conventional steel.

According to a further preferred embodiment, the holder for sanding elements is tiltably and/or rotatably bearing-mounted on said sanding frame. An advantage is that the sanding zones of the sanding elements then adapt themselves to the floor area. According to a non-restrictive example, the holders for sanding elements are provided on said sanding frame via spherical bearings. Thereby the holders are individually bitable in a very rigid manner. The rotation-coupling between adapter and receiver is not bitable and therefore less susceptible to wear and deformations.

According to a further preferred embodiment, the holder for sanding elements comprises means for detachable attachment of exchangeable sanding elements, said means comprising a Velcro hook side. An advantage is that the sanding elements thereby can, simply and repeatedly, be removably attached to the holders. Velcro connections are also applicable in moist/wet environments, which is typically the case when sanding stone and concrete floors. Preferably, said Velcro hook side is circular, and suitable for attachment of a circular, exchangeable sanding element.

According to a further preferred embodiment, the subframe comprises means for detachable coupling with a blade rotor. Preferably, said means are provided along an upper side of the subframe. Preferably, the subframe is provided with hooks along the upper side, on which the trowel blades of the blade rotor of a power trowel can engage. The device then comprises a power trowel, said power trowel comprising the frame of the device and the motor. An advantage is that a power trowel can hereby, in a simple manner and non-definitively, be deployed as a sanding machine. Power trowels are often provided with rotating jack wheels as described above. An advantage is then that the sanding elements can be simply changed after screwing out the rotating jack wheels, the sanding frame being detached from the device. According to an alternative embodiment however, the device comprises a motor with motor shaft, said motor shaft being directly coupled with the subframe.

It is also possible that the device as described above comprises several subframes, each rotationally coupled or able to be rotationally coupled with sanding frames. Preferably such coupling and decoupling of each of the sanding frames moreover takes place simultaneously.

In a second aspect, the invention describes a sanding frame for sanding floor areas. In particular, said sanding frame is suitable for use in the device described above. In this regard, the advantage that the sanding elements can be simply exchanged is again applicable.

In a further or alternative embodiment, the sanding frame is centrally provided along the upper side with a receiver suitable for receiving an adapter, and the sanding frame is provided along the lower side with at least one holder for sanding elements. With further preference, the sanding frame is provided with two or more holders, and with further preference with three or more holders, for example with three, four, five or six holders for sanding elements. Preferably, the sanding frame is suitable for rotation coupling with a subframe, by means of free loading as described above. Preferably this coupling comprises no interlocking means. Optionally, however, said coupling does comprise one or more interlocking means.

In a further aspect, the invention describes a sanding element for sanding floor areas, the sanding element comprising a fibre membrane and one or more grinding stones. In particular, the sanding element moreover comprises a reinforcing skin, said reinforcing skin extending along one side of said fibre membrane; the grinding stones are provided on the other side on said reinforcing skin. The grinding stones preferably comprise sanding grains in a matrix of metal and/or plastic. Suitable sanding grains are diamond particles. Preferably said grinding stones are glued along the rear side with the reinforcing skin. To this end, a water-resistant glue is preferably used. The fibre membrane is preferably disc-shaped, with a thickness of minimally 2 mm and maximally 50 mm, with further preference a thickness between 8 mm and 30 mm and with further preference a thickness of approximately 15 mm. Preferably, the fibre membrane comprises a nonwoven material with fibres or filaments.

Preferably, the sanding element just described is suitable for use in combination with the device described above. In this regard, the fibre membrane is suitable for working together with the Velcro hook side of the holders for sanding elements. An advantage of the incorporation of a reinforcing skin is that the sanding element is thereby stiffer. As a consequence thereof, the Velcro connection with the (also stiff) hook side of the holder is much stronger: a possible separating force is after all simultaneously distributed over all hooks of the Velcro hook side.

According to a further or alternative embodiment, each sanding element comprises two or more of above-mentioned grinding stones, for example two, three, four, five, six, seven, eight, nine or ten grinding stones, which are decentrally provided. The decentral provision of the grinding stones on the sanding element, and the decentral provision of the sanding elements (e.g. two, three, four, five, six, seven, eight, nine or ten sanding elements) on the (optionally rotatable) holders of the sanding frame, brings about an evenly wearing off of the grinding stones, within each sanding element and between mutual sanding elements respectively. Preferably three, four or five sanding stones are provided per sanding element. Preferably three, four or five holders for sanding elements are provided per sanding frame. Preferably the holders for sanding elements are rotatably provided on the sanding frame.

Preferably, a set of sanding elements be used for sanding a floor area of 2000 $m^2$ to 3000 $m^2$, Preferably, a set of sanding elements can be used in combination with above-mentioned device and/or with above-mentioned sanding frame. In this regard, those same features can be adopted, and in this regard those same advantages can be repeated.

In a further aspect, the invention describes a product for use in combination with the device described above, for hardening or densifying floor areas. In particular, said product comprises lithium silicates and/or sodium silicates.

In a further aspect, the invention describes a product for use in combination with the device described above, for providing a stain-resistant layer to floor areas. In particular, said product comprises fluorised silanes.

In a further aspect, the invention describes a method for treating floor areas. In particular, said method comprises the use of the device described above. Preferably said method moreover comprises the use of one or both of the products described above.

In a further aspect, the invention describes a floor made of concrete or stone. In particular, said floor comprises a floor area, said floor area being obtained by application of the method.

In a further aspect, the invention describes a kit for sanding floor areas, the kit comprising an adapter as described above. In particular, the kit moreover comprises a sanding frame as described above, said sanding frame comprising a receiver suitable for receiving the adapter.

According to a further preferred embodiment, the kit moreover comprises a floating disc, said floating disc being suitable for detachable attachment to a blade rotor. For example, the floating disc and the adapter are shipped as separate parts, with as an advantage that they then take up less space. They are connected at a later stage, for example by the user or by the seller of the kit, by welding the steel adapter under the steel floating disc. Alternatively, the adapter can be connected to the floating disc in another manner, for example by means of bolts and such. The floating disc with adapter then forms part of the subframe of the device as described above. Said device moreover comprises a power trowel with a blade rotor which can engage with aforementioned floating disc. According to an alternative embodiment, the kit does not comprise a floating disc. Such a standard floating disc is then provided by the customer himself/herself. Another other possibility is that the kit comprises a subframe, said subframe comprising the floating disc and the adapter already connected with each other. An advantage is that the kit is ready for connection with the blade rotor of a power trowel.

The above-described kit can of course comprise a plurality of sanding frames, subframes and/or adapters, for example for use in combination with power trowels comprising several blade rotors.

According to a preferred embodiment, the kit moreover comprises a plurality of exchangeable sanding elements as described above.

In that which follows, the invention is described on the basis of non-restrictive examples which illustrate the invention, and are not intended or to be interpreted as restricting the scope of the invention.

FIG. 1 shows a perspective drawing of an embodiment of a sanding frame 1 according to present invention. The sanding frame 1 is centrally provided with a receiver 2 along the upper side. The receiver 2 defines an upwardly directed receiving recess 3 with square profile, with square sides of approximately 25 cm. The receiver 2 itself is manufactured from a substantially square, cutout piece of steel plate, said piece of steel plate comprising a small folding flap on each of the square sides. In a following manufacturing step, said folding flaps are folded over. Thereby they stand transversely on the central, square piece of steel plate, forming a collar 4. Said collar 4 provides a lateral delimitation of the receiving recess 3, so that the receiver 2 is suitable to be rotationally coupled with a form-corresponding (square) or form-fitting adapter 7. Along the lower side, the sanding frame 1 is provided with four holders 5 for circular sanding elements. Said holders 5 are bearing-mounted on the sanding frame 1 by means of spherical bearings 6.

Figure 2:
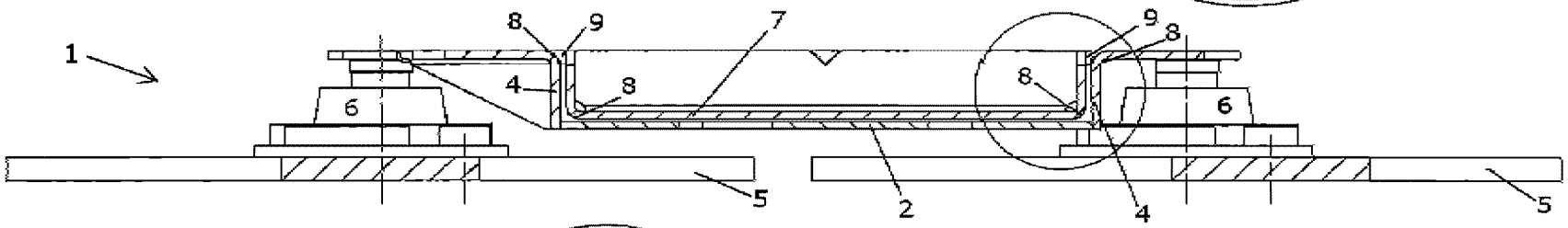
FIG. 2 shows a cross section of an embodiment of a sanding frame with an upwardly directed receiver, said receiver receiving a downwardly directed adapter.

FIG. 2 shows a cross section of an embodiment of a sanding frame 1 with upwardly directed receiver 2, said receiver 2 receiving a downwardly directed adapter 7. The edges 8 of both the adapter 7 and the receiver 2 are rounded, which facilitates the coupling between both. Moreover, the profile of the adapter 7 is slightly smaller in size than the profile of the receiver 2, to further facilitate the coupling between both. In this regard, the adapter 7 comprises packing blocks 9, for improved form-fitting of the adapter 7 in the receiver 2. This sanding frame 1 also is provided along the lower side with holders 5 for sanding elements. Said holders 5 are bearing-mounted on said sanding frame 1 by means of spherical bearings 6.

Figure 3:
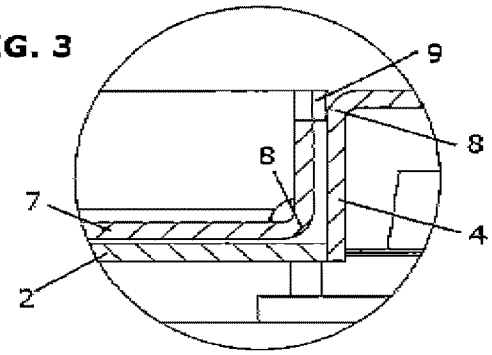
FIG. 3 shows a detail of the circumscribed part in the cross section of FIG. 2.

FIG. 3 shows a detail of the circumscribed part in the cross section of FIG. 2.

Figure 4:
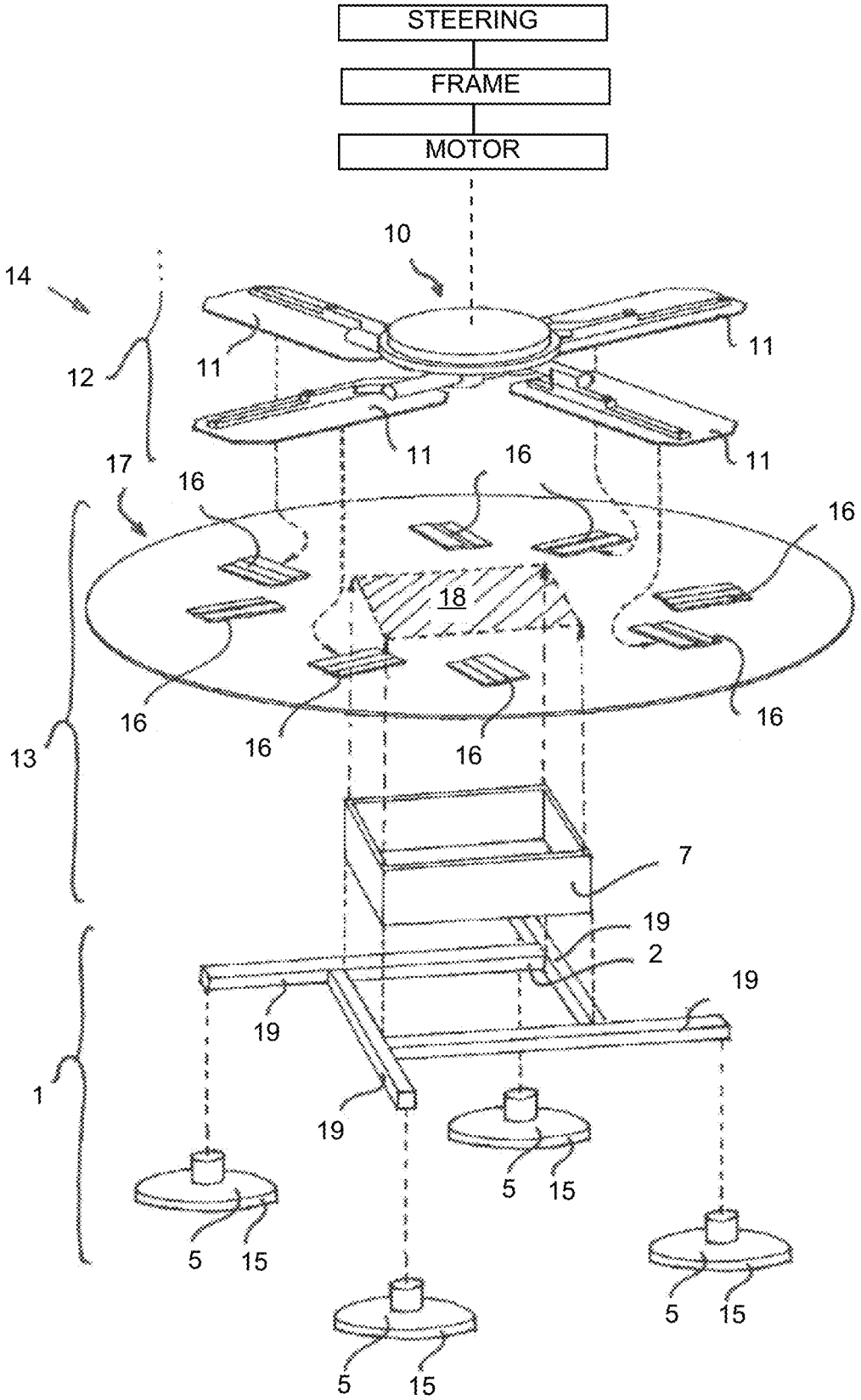
FIG. 4 shows another schematic, exploded-view drawing of a device for sanding floor areas, according to a possible embodiment of the invention.

FIG. 4 shows another schematic, exploded-view drawing of a device 14 for sanding floor areas, according to a possible embodiment of the invention. Said device 14 comprises in this regard a Frame, a steering and a motor (this superstructure is not shown in the figure), and further another blade rotor 10 with trowel blades 11. In particular, the motor is rotatably supported by the blade rotor 10, the motor being suitable for bringing the blade rotor 10 into rotation with respect to the frame and the floor area. Optionally the frame, the steering, the motor and the blade rotor are enclosed by a power trowel 12, as used inter alia for levelling concrete mortar during hardening.

Now the device 14 further comprises another subframe 13 that can be removably coupled with the blade rotor 10, and thus also with aforementioned motor, the motor being suitable for bringing said subframe 13 into rotation. A possible coupling manner is shown in the figure by means of dashed arrows. In particular, the subframe 13 is thereto provided with hooks 16 along the upper side, on which aforementioned trowel blades 11 can simply engage. Further, the subframe 13 is also centrally provided with an adapter 7 along the lower side. Optionally, the subframe 13 is inter alia composed of a floating disc 17, said floating disc 17 being provided with an adapter 7 along the lower side. For example, such an adapter 7 can be attached along the lower side of a floating disc 17 by welding it against the same, or via attachment means such as bolts/screws, e.g. through a thereto provided flange on the adapter 7. As still further shown in the figure, the mutual attachment of the floating disc 17 and the adapter 7 runs according to dashed arrows and near an imaginary attachment zone 18 on the lower side (shown through the floating disc 17).

Finally, the device 14 comprises another sanding frame 1, said sanding frame 1 being centrally provided along the upper side with a receiver 2 for receiving the downwardly directed adapter 7. Said receiver 2 is formed between four steel tubes 19 of substantially the same length, which are welded together in square connection. In particular, the subframe is freely supported by the sanding frame 1, via said adapter 7 and receiver 2, said adapter 7 and receiver 2 in this regard being rotationally coupled. The adapter 7 and receiver 2 possess a form-corresponding, square profile. With this "free loading" it is possible, for example, that the lower side of the floating disc 17 rests on the upper side of the tubes 19. Optionally, the adapter 7 and/or the receiver 2 comprise rounded edges (not shown) for simplifying their mutual coupling. Along the lower side, the sanding frame 1 is further also provided with four holders 5 for sanding elements 15, suitable for the attachment of sanding elements 15.

An important advantage of this embodiment is that it allows a power trowel 12 to be deployed in a simple and reversible manner as a sanding device 1, using parts which are per se known and/or relatively simple (comprising a floating disc 17, an adapter 7, a sanding frame 1 with receiver 2 and sanding elements 15). Moreover, it is possible in this regard to replace the sanding elements 15 in a simple manner; the subframe 13 (and the power trowel 12) are, after all, freely supported by the sanding frame 12, by means of the form-corresponding adapter 7 and receiver 2. As a consequence, it suffices to raise the subframe 13 vertically (e.g. via rotating jack wheels or small rotating jack feet, often provided with a power trowel 12), in order to disengage the coupling from the sanding frame 12. The sanding elements 15 on the loose sanding frame 1 can then be replaced in a simple manner. It should yet be emphasized that power trowels 12 are typically relatively heavy, so that a coupling with the sanding frame via "free loading" typically suffices. Preferably, this freely supported coupling thus does not comprise interlocking elements for interlocking said freely supported coupling, since this would make the replacement of the sanding elements 15 unnecessarily complicated. Optionally, however, one or more of such interlocking means are indeed provided.

Figure 5A:
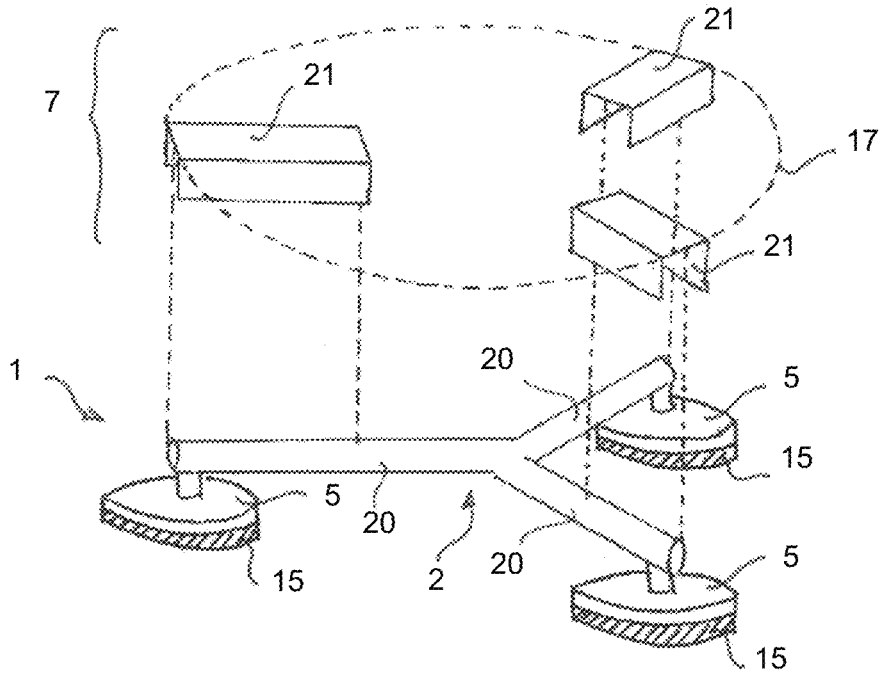
FIGS. 5A-B are perspective drawings of a kit for sanding floor areas, according to another two possible embodiments of the invention.
Figure 5B:
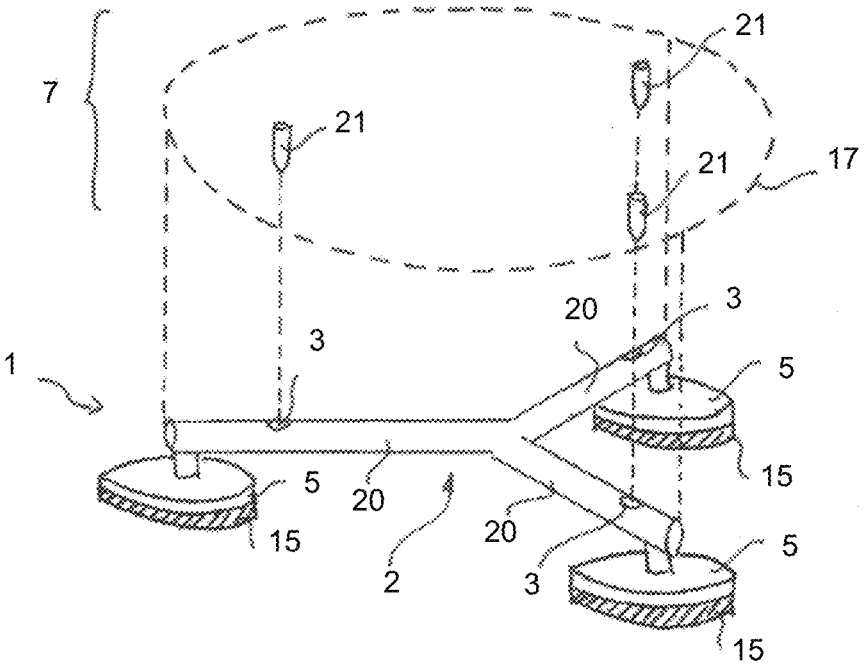

FIGS. 5A-B are perspective drawings of a kit for sanding floor areas, according to another two possible embodiments of the invention. It will be clear that the features in connection with the kit can also be applicable to the device according to the first aspect of the invention, and/or on the sanding frame according to the second aspect of the invention.

The kit shown comprises a sanding frame 1 with three bearing shafts 20 mutually connected in star form from a central point. In this regard, each bearing shaft 20, at its extremity, is provided with a holder 5 for sanding elements 15 along the lower side. The bearing shafts 20 themselves form a substantially star-shaped receiver 2, over which a downwardly directed adapter 7 can be form-fittingly enclosed. Said adapter 7 comprises in this regard three pieces of U-profile 21 that can be attached in star form to the lower side of a floating disc 1. Possible contours of such a floating disc 17 are shown in dotted lines. Floating discs 17 are known by the person skilled in the art; they do not necessarily form part of the kit itself. Optionally, however, the adapter parts 21 are already attached to such a floating disc 17. Alternatively, the floating disc 17 and adapter parts 21 are provided separately, which simplifies shipping and storage.

FIG. 5B shows another perspective drawing of a kit according to an alternative embodiment, strikingly similar to the embodiment of FIG. 5A. However, in the present embodiment, the adapter comprises three downwardly directed pins 21. These can be form-fittingly enclosed within three corresponding receiving recesses 3 thereto provided in the bearing shafts 20.

Further, in both FIG. 5A and FIG. 5B, it is so that the adapter 7 comprises two or more adapter parts 21. Said adapter parts 21 can be decentrally provided on the lower side of a floating disc 17, for example. In this regard they form a central adapter 7, for working together with the central receiver 2. As an advantage, a larger load arm arises in this regard for transferring a central moment of force between the subframe 13 and the sanding frame 1. On the other hand, the coupling of the subframe 13 with the sanding frame 1 will typically proceed in a more difficult manner.

According to alternative embodiments, the adapter 7 comprises only one adapter body that is provided centrally on the subframe 13, for example centrally along the lower side of a floating disc 17. Upon the attachment of such an adapter 7 on a floating disc 17, for example, this allows for a more simple positioning (of only one adapter part). Optionally, this will also facilitate the mutual coupling, in particular if the adapter 7 and/or receiver 2 are bevelled off. In a possible embodiment, the adapter part 21 is substantially oval or polygonal (e.g. square, rectangular or star-shaped).

The numbered elements in the figures are:

1. Sanding frame
2. Receiver
3. Receiving recess
4. Collar
5. Holder for sanding elements
6. Spherical bearing
7. Adapter
8. Rounded edges
9. Packing blocks
10. Blade rotor
11. Trowel blades
12. Power trowel
13. Subframe
14. Device
15. Sanding element
16. Hook
17. Floating disc
18. Attachment zone
19. Tube
20. Bearing shaft
21. Adapter part Example 1

A typical method for sanding a floor area comprises the following steps. If one or more of these steps are not applicable, they can be skipped. For sanding the floor, use is always made of the device described above, 1. The cleaning of the floor area to remove contaminations such as oil, paint, grease and glue,
2. Filling up holes,
3. The removal of protruding parts such as bolts,
4. The moistening of the floor, preferably with water,
5. The sanding of the floor in wet state with grain 50 sanding elements, four times in successive perpendicular directions; the floor area is meanwhile regularly cleaned and moistened,
6. The sanding of the floor in wet state with grain 120 sanding elements, four times in successive perpendicular directions; the floor area is meanwhile regularly cleaned and moistened,
7. The application on the floor area of a product comprising lithium silicates or sodium silicates, for hardening of the floor,
8. The action of the product by the sanding of the floor in wet state with grain 200 sanding elements, four times in successive perpendicular directions; the floor area is meanwhile regularly cleaned and moistened,
9. The sanding of the floor in wet state with grain 400 sanding elements, four times in successive perpendicular directions; the floor area is meanwhile regularly cleaned and moistened,
10. Leaving the floor to dry,
11. The polishing of the floor with grain 800 sanding elements, twice in successive perpendicular directions
12. The cleaning of the floor,
13. The polishing of the floor with grain 1500 sanding elements, twice in successive perpendicular directions,
14. The cleaning of the floor,
15. The application of a product comprising fluorised silanes, for providing a stain-resistant layer to the floor,
16. Leaving the product to dry,
17. The polishing of the floor with grain 3000 sanding elements, twice in successive perpendicular directions, and
18. The cleaning of the floor.

It is assumed that the present invention is not restricted to the embodiments described above and that some modifications of, or changes to the examples described can be added without reassessment of the attached claims.

The invention claimed is:

1. A device (14) for sanding floor areas, the device (14) comprising a frame, a steering and a motor, said motor being provided to said frame, the device (14) further comprising:

a subframe (13) that is rotatably coupled with said motor, the motor being suitable for bringing said subframe (13) into rotation, said subframe (13) being centrally provided with an adapter (7) along a lower side, a sanding frame (1), said sanding frame (1) along an upper side being centrally provided with a receiver (2), said receiver (2) receiving said adapter (7), and at least one holder (5) for sanding elements (15), said holder (5) being provided along a lower side of said sanding frame (1), and being suitable for the attachment of the sanding elements (15), characterized in that the subframe (13) is freely supported by the sanding frame (1), via said adapter (7) and said receiver (2), said adapter (7) and said receiver (2) being rotationally coupled; and characterized in that the at least one holder (5) for the sanding elements (15) is tiltably and/or rotatably bearing-mounted on said sanding frame (1).

2. The device (14) according to claim 1, characterized in that the device further comprises a blade rotor (10), whereby the subframe (13) comprises, along an upper side, means (16) for detachable coupling thereof with the blade rotor (10).

3. The device (14) according to claim 1, characterized in that the adapter (7) and the receiver (2) are form-corresponding.

4. The device (14) according to claim 1, characterized in that the adapter (7) has a polygonal profile.

5. The device (14) according to preceding claim 4, characterized in that the adapter (7) has a square profile.

6. The device (14) according to claim 1, characterized in that the holder (5) for sanding elements (15) comprises means for detachable attachment of exchangeable sanding elements (15), said means comprising a hook side of a hook and loop fastener.

* * * * *